US007914348B1

(12) United States Patent
Lin

(10) Patent No.: US 7,914,348 B1
(45) Date of Patent: Mar. 29, 2011

(54) PROBE CONNECTOR

(75) Inventor: Ming-Han Lin, Taipei (TW)

(73) Assignee: Cheng Uei Precision Industry Co., Ltd., Taipei (TW)

( * ) Notice: Subject to any disclaimer, the term of this patent is extended or adjusted under 35 U.S.C. 154(b) by 0 days.

(21) Appl. No.: 12/815,401

(22) Filed: Jun. 15, 2010

(51) Int. Cl.
*H01R 13/24* (2006.01)

(52) U.S. Cl. ..... 439/700; 439/824

(58) Field of Classification Search ..... 439/700, 439/824, 289, 482
See application file for complete search history.

(56) References Cited

U.S. PATENT DOCUMENTS 6,935,906 B2 * 8/2005 Orihara ..... 439/824
7,435,109 B1 * 10/2008 Sugiura ..... 439/83
7,662,000 B2 * 2/2010 Hou et al. ..... 439/824
7,815,474 B1 * 10/2010 Lin et al. ..... 439/700

* cited by examiner

*Primary Examiner* — Briggitte R Hammond
*Assistant Examiner* — Larisa Z Tsukerman

(57) ABSTRACT

A probe connector includes an insulating housing having a base, and a plurality of probe pin assemblies. The base defines a front surface which has a plurality of inserting holes arranged side by side. The inserting hole has a channel at a bottom thereof and reaching a rear surface of the base, and a mating lump protruded inwards from a rear portion of an inner surface thereof. The probe pin assembly has a cylindraceous barrel received in the inserting hole, an elastic element accommodated in the barrel, and a plunger. The barrel has a notch at a rear end of a periphery thereof for engaging with the mating lump. A conduct element of strip shape is extended rearwards from the rear end of the barrel, and exposed out of the insulating housing through the channel for being soldered to a PCB.

9 Claims, 4 Drawing Sheets

PROBE CONNECTOR

BACKGROUND OF THE INVENTION

1. Field of the Invention

The present invention relates to a probe connector, and particularly to a probe connector connected to a PCB.

2. The Related Art

Please refer to FIG. 1, a conventional probe connector 5 for transmitting electrical signals is generally involved with an insulating housing 501, a probe pin assembly 502 mounted in the insulating housing 501, and a conduct element 503. The conduct element 503 is substantially L-shaped. One free end of the conduct element 503 is formed with a positioning hole 504. The probe pin assembly 502 is restrained in the positioning hole 504 for fixing the probe pin assembly 502 to the insulating housing 501. The other free end of the conduct element 503 is defined as a soldering end 505, which extends out of the insulating housing 501 for being soldered to a printed circuit board (PCB, not shown). Therefore, the probe pin assembly 502 is electrically connected with the PCB by means of the conduct element 503.

However, since the conduct element 503 is manufactured and used to connect the probe pin assembly 502 and the PCB electrically, as a conductor, it is possible to aggravate the heat generation of an electrical device which is equipped with the probe connector 5 in work, because of the large resistivity of the conduct element 503, as a result, which decreases the use lifetime of the electrical device. Furthermore, the conduct element 503 is a single piece and should be specially manufactured and assembled, which not only increases the manufacturing cost, but also demands the higher assembling precision for guaranteeing transmitting stability.

SUMMARY OF THE INVENTION

Accordingly, an object of the present invention is to provide a probe connector connected to a PCB. The probe connector includes an insulating housing having a base, and a plurality of probe pin assemblies. The base defines a front surface which has a plurality of inserting holes arranged side by side. Each of the inserting holes has a channel at a bottom thereof and reaching a rear surface of the base, and a mating lump protruded inwards from a rear portion of an inner surface thereof. The probe pin assembly has a cylindraceous barrel received in the inserting hole, an elastic element accommodated in the barrel, and a plunger having one end restrained in the barrel and against the elastic element, and the other end extending out from a front opening of the barrel. The barrel has a notch at a rear end of a periphery thereof for engaging with the mating lump. A conduct element of strip shape is extended rearwards from the rear end of the barrel, and exposed out of the insulating housing through the channel for being soldered to the PCB.

As described above, the probe connector is provided with the conduct element which is extended from the barrel and soldered to the PCB to connect the barrel and the PCB electrically and directly, which not only decreases the heat generation, prolonging the use lifetime of the probe connector, but also simplifies the assembling process, guaranteeing the stable transmission of the electrical signals. In addition, the barrel has the notch engaged with the mating lump, which is excellent to position the barrel in the inserting hole, improving the connection stability of the probe connector.

BRIEF DESCRIPTION OF THE DRAWINGS

The present invention will be apparent to those skilled in the art by reading the following description thereof, with reference to the attached drawings, in which.

DETAILED DESCRIPTION OF THE EMBODIMENT

Figure 1:
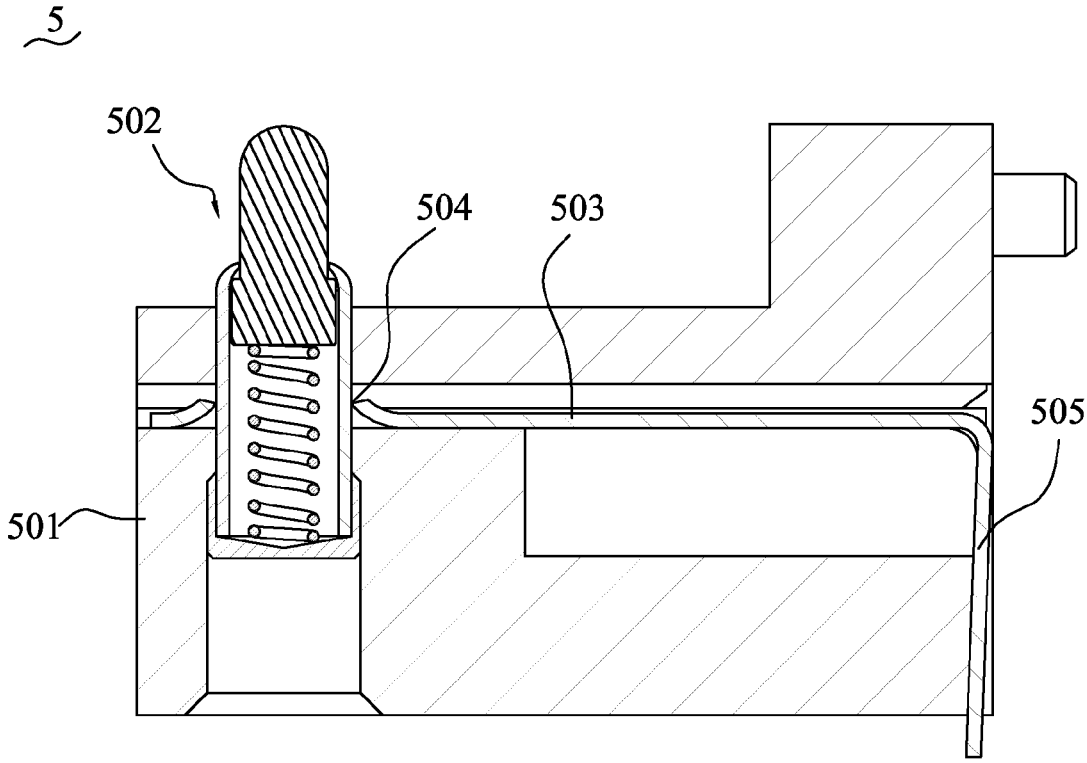
FIG. 1 (Prior Art)
FIG. 1 is a cross-sectional view of a probe connector in prior art.
Figure 2:
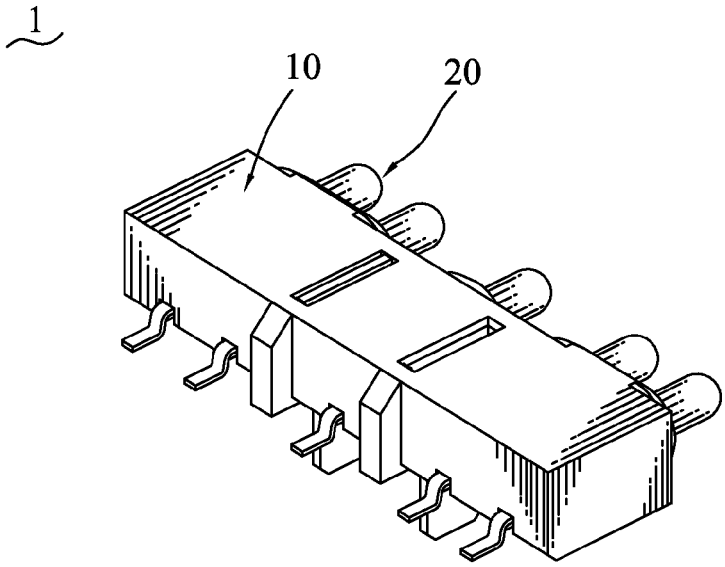
FIG. 2 is an assembled, perspective view of a probe connector of an embodiment in accordance with the present invention.
Figure 3:
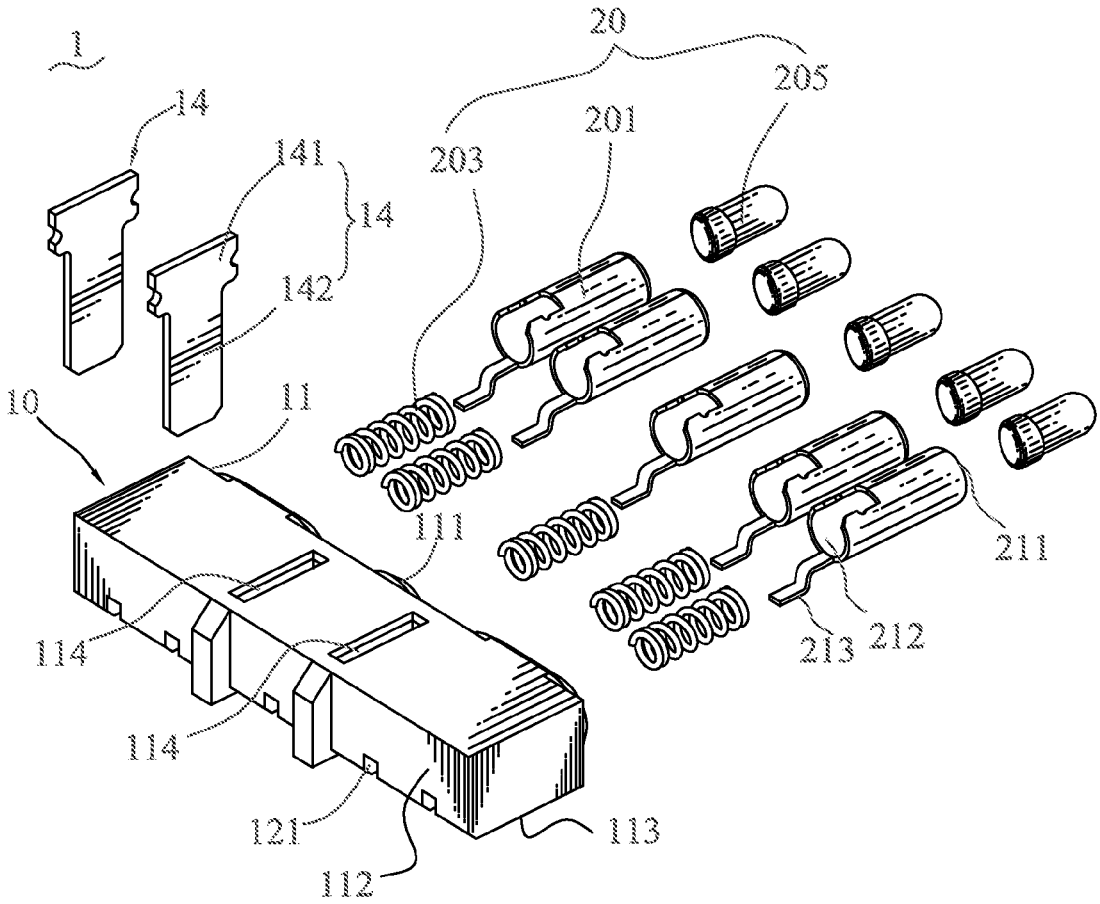
FIG. 3 is an exploded, perspective view of the probe connector shown in FIG. 2.
Figure 4:
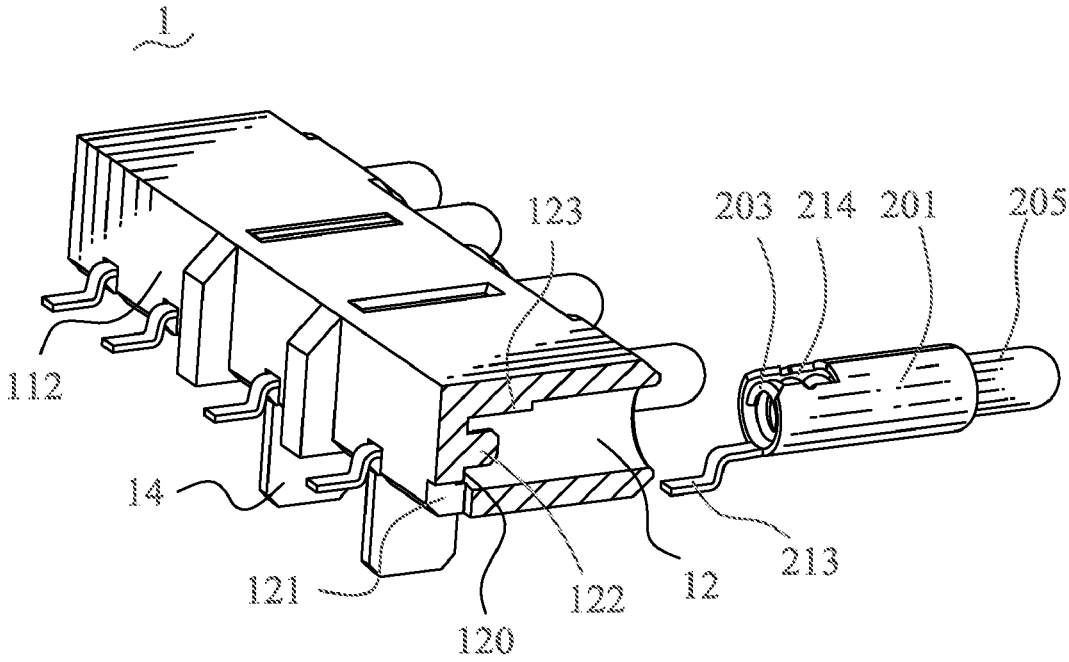
FIG. 4 is a cross-sectional view showing an inserting hole of the probe connector of FIG. 2, wherein a probe pin assembly is disassembled form the inserting hole.

Referring to the drawings in greater detail, and first to FIGS. 2-4, the embodiment of the present invention is embodied in a probe connector 1. The probe connector 1 includes an insulating housing 10, a plurality of probe pin assemblies 20 mounted to the insulating housing 10. The insulating housing 10 has a substantially rectangular base 11. The base 11 defines a front surface 111, a rear surface 112, and a bottom surface 113 connecting with the front surface 111 and the rear surface 112. The front surface 111 has a plurality of columned inserting holes 12 for receiving the probe pin assemblies 20. The inserting holes 12 are arranged side by side and extend rearward a predetermined distance, with closed rear ends formed thereof. In this embodiment, there are five inserting holes. Each of the inserting holes 12 has a channel 121 at a bottom 120 thereof and reaching the rear surface 112. In this embodiment, the bottom 120 of the inserting hole 12 is further protruded frontward to form a positioning post 122 at a middle portion thereof. An inner surface of the inserting hole 12 has a rear portion protruded inwards to form a mating lump 123. The mating lump 123 extends to reach the bottom 120 and is located opposite to the channel 121 with respect to the positioning post 122.

The base 11 has a top surface formed with two abreast fixing slots 114 for receiving a pair of fixing elements 14. The fixing slots 114 extends frontward and rearwards, and penetrate the bottom surface 113. In this embodiment, the fixing slot 114 is located between and spaced from the two adjacent inserting holes 12. The fixing element 14 is substantially a T shape, and has a rectangular fixing section 141 and an inserting section 142 extending perpendicularly from a middle of a long edge of the fixing section 141. The fixing section 141 is received in the fixing slot 114. The inserting section 142 extends out of the bottom surface 113 of the insulating housing 10 for being secured to a printed circuit board (PCB, not shown), thereby fixing the insulating housing 10 to the PCB.

Figure 5:
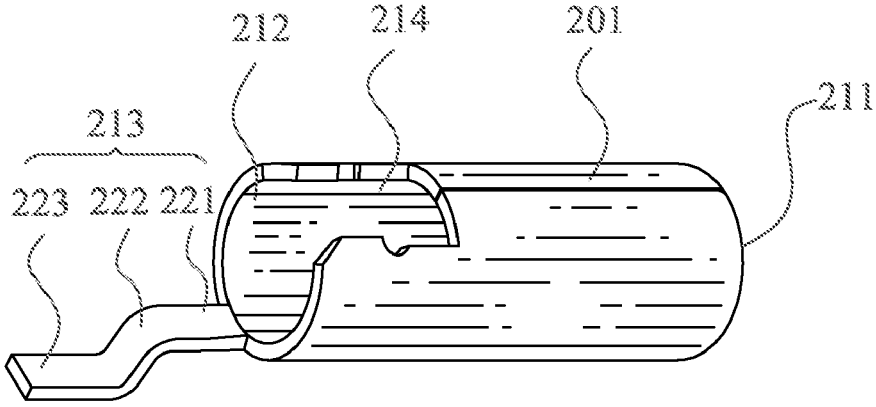
FIG. 5 is a perspective view of a barrel of the probe pin assembly shown in FIG. 3.

Please refer to FIG. 3 and FIG. 5, the probe pin assembly 20 includes a hollow barrel 201, a plunger 205 and an elastic element 203 received in the barrel 201. The barrel 201 and the plunger 205 are made of metallic material. The barrel 201 is cylindraceous and defines a front opening 211 for exposing the plunger 205, and a rear opening 212 opposite to the front opening 211. A notch 214 is formed at a rear portion of the barrel 201 and communicates with the rear opening 212. The barrel 201 is connected with a conduct element 213 of strip shape. The conduct element 213 has a connecting portion 221 extended rearwards from a portion of an edge of the rear opening 212 opposite to the notch 214, a transition 222 bent outwards from a free end of the connecting portion 221, and a soldering portion 223 extending rearwards from a free end of the transition 222. The soldering portion 223 is parallel to the connecting portion 221. It should be noted that the shape of the barrel could be changed for meeting different demands and should not be limited. For example, the barrel can be formed with a closed rear end when the positioning post is unformed. Or, the closed rear end of the barrel has a hole for allowing the positioning post to pass therethrough to position the elastic element.

The plunger 205 has a rear end restrained in the barrel 201 and resting against a front end of the elastic element 203, and a front end extending out of the barrel 201 through the front opening 211 for electrically contacting an electronic device (not shown). Herein, the elastic element 203 is a spring. The spring 203 has a rear end exposed from the rear opening 212 and engaged with the positioning post 122 for positioning the spring 203 and adjusting the compression and distortion of the spring 203.

Figure 6:
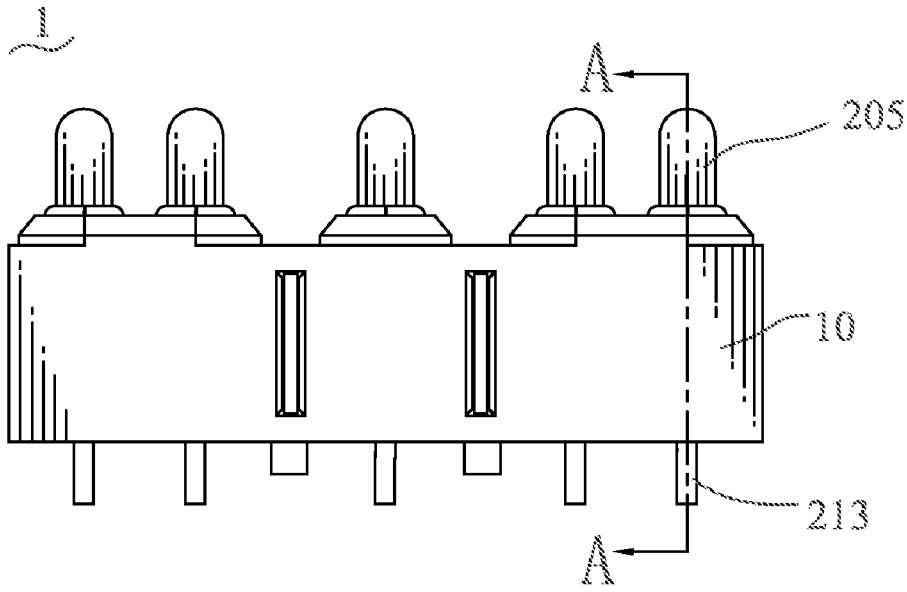
FIG. 6 is an assembled, perspective view of the probe connector of FIG. 2 seen from a top angle.
Figure 7:
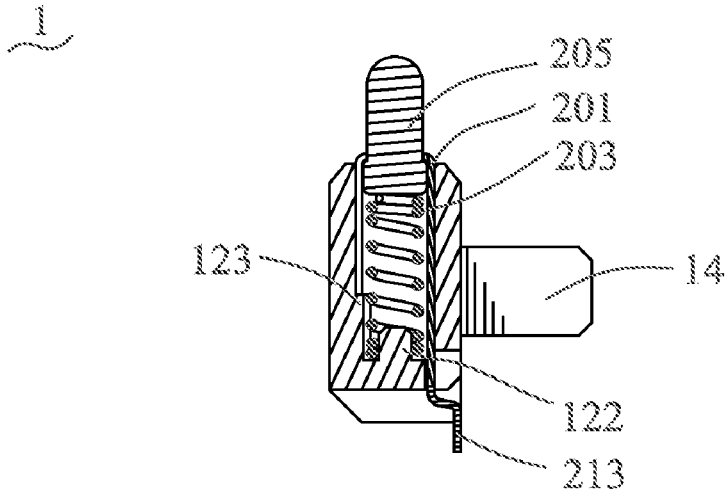
FIG. 7 is cross-sectional view taken along a line A-A of FIG. 6.

With reference to FIGS. 6-7, in assembly, the probe pin assembly 20 is adjusted and inserted into the inserting hole 12. The notch 214 is coupled with the mating lump 123. The soldering portion 223 passes through the channel 121 and exposes out of the insulating housing 10. The soldering portion 223 is substantially flush with the bottom surface 113. The rear end of the spring 203 is located by the positioning post 122, and the front end of the spring 203 supports the plunger 205 so that the front end of the plunger 205 extends out of the front surface 111 of the insulating housing 10. The bottom surface 113 of the probe connector 1 is attached to the PCB, the fixing elements 14 are respectively inserted into the fixing slots 114 and fastened in installing slots of the PCB (not shown) for fixing the insulating housing 10 to the PCB. The soldering portions 223 are soldered to the PCB.

As described above, the probe connector 1 is provided with the conduct element 213 which is extended from the barrel 201 and soldered to the PCB to connect the barrel 201 and the PCB electrically and directly, which not only decreases the heat generation, prolonging the use lifetime of the probe connector 1, but also simplifies the assembling process, guaranteeing the stable transmission of the electrical signals. In addition, the barrel 201 has the notch 214 engaged with the mating lump 123, which is excellent to position the barrel 201 in the inserting hole 12, improving the connection stability of the probe connector 1.

What is claimed is:

1. A probe connector for being connected to a PCB, comprising:

an insulating housing having a base, the base defining a front surface, the front surface having a plurality of inserting holes arranged side by side, each of the inserting holes having a channel at a bottom thereof and reaching a rear surface of the base, and a mating lump protruded inwards from a rear portion of an inner surface thereof; and a plurality of probe pin assemblies, the probe pin assembly having a cylindraceous barrel received in the inserting hole, an elastic element accommodated in the barrel, and a plunger having one end restrained in the barrel and against the elastic element and the other end extending out from a front opening of the barrel, the barrel having a notch at a rear end of a periphery thereof for engaging with the mating lump, a conduct element of strip shape being extended rearwards from the rear end of the barrel, and exposed out of the insulating housing through the channel for being soldered to the PCB.

2. The probe connector as claimed in claim 1, wherein the barrel defines a rear opening, the elastic element has one end opposite to the plunger exposed from the rear opening and engaged with a positioning post protruded inwards from the bottom of the inserting hole.

3. The probe connector as claimed in claim 2, wherein the notch communicates with the rear opening.

4. The probe connector as claimed in claim 2, wherein the conduct element has a connecting portion extended rearwards from a portion of an edge of the rear opening, a transition bent outwards from a free end of the connecting portion, and a soldering portion extending rearwards from a free end of the transition.

5. The probe connector as claimed in claim 4, wherein the soldering portion is parallel to the connecting portion.

6. The probe connector as claimed in claim 4, wherein the soldering portion is substantially flush with a bottom surface of the base which is attached to the PCB.

7. The probe connector as claimed in claim 1, wherein a conjunction between the barrel and the conduct element is disposed substantially opposite to the notch.

8. The probe connector as claimed in claim 1, wherein the base has a plurality of fixing slots at a top surface thereof, the fixing slots penetrate a bottom surface of the base, a plurality of fixing elements are engaged with the fixing slots, and have portions projecting out of the bottom surface of the base for being fixed to the PCB.

9. The probe connector as claimed in claim 8, wherein the fixing element is substantially a T shape, and has a rectangular fixing section and an inserting section extending perpendicularly from a middle of an edge of the fixing section, the fixing section is received in the fixing slot, the inserting section extends out of the bottom surface of the base for being secured to a PCB.

* * * * *